US009607565B2

(12) United States Patent
Lee

(10) Patent No.: US 9,607,565 B2
(45) Date of Patent: Mar. 28, 2017

(54) DISPLAY DEVICE AND METHOD OF INITIALIZING GATE SHIFT REGISTER OF THE SAME

(71) Applicant: LG DISPLAY CO., LTD., Seoul (KR)

(72) Inventor: Hyunjae Lee, Goyang-si (KR)

(73) Assignee: LG DISPLAY CO., LTD, Seoul (KR)

( * ) Notice: Subject to any disclaimer, the term of this patent is extended or adjusted under 35 U.S.C. 154(b) by 70 days.

(21) Appl. No.: 14/577,026

(22) Filed: Dec. 19, 2014

(65) Prior Publication Data

US 2015/0187313 A1 Jul. 2, 2015

(30) Foreign Application Priority Data

Dec. 26, 2013 (KR) ..... 10-2013-0164613

(51) Int. Cl.
*G09G 3/36* (2006.01)

(52) U.S. Cl.
CPC ..... *G09G 3/3674* (2013.01); *G09G 3/3677* (2013.01); *G09G 2310/0286* (2013.01); *G09G 2310/0289* (2013.01)

(58) Field of Classification Search
CPC ..... G09G 3/3674; G09G 3/3677; G09G 2310/0286; G09G 2310/0289
USPC ..... 345/100; 377/64–81
See application file for complete search history.

(56) References Cited

U.S. PATENT DOCUMENTS

| | | | | |
|---|---|---|---|---|
| 8,842,061 | B2 * | 9/2014 | Chen | G11C 19/28 345/100 |
| 2008/0136756 | A1 * | 6/2008 | Yeo | G09G 3/3677 345/87 |
| 2011/0222645 | A1 * | 9/2011 | Tobita | G09G 3/3677 377/78 |
| 2013/0083885 | A1 * | 4/2013 | Lee | G11C 19/28 377/69 |
| 2013/0249876 | A1 * | 9/2013 | Huang | G11C 19/28 345/205 |

FOREIGN PATENT DOCUMENTS

| | | | |
|---|---|---|---|
| CN | 101752004 | A | 6/2010 |
| CN | 102298896 | A | 12/2011 |
| CN | 102651186 | A | 8/2012 |
| TW | 201013625 | A | 4/2010 |
| TW | 201110551 | A | 3/2011 |
| TW | 201331923 | A | 8/2013 |
| WO | 03091978 | A1 | 11/2003 |
| WO | 2013/088799 | A1 | 6/2013 |

* cited by examiner

*Primary Examiner* — Michael Pervan
(74) *Attorney, Agent, or Firm* — Dentons US LLP

(57) ABSTRACT

Disclosed is a display device that comprises: a display panel; a level shifter shifting a start pulse, an initialization pulse, and N (N is an integer equal to or greater than 2)-phase shift clocks to a predetermined voltage; and a gate shift register comprising multiple stages respectively connected to scan lines of the display panel and shifting the start pulse in response to the N-phase shift clocks within a driving period defined by the start pulse to sequentially output a scan pulse, wherein the stages are simultaneously reset in response to the initialization pulse and the N-phase shift clocks within an initialization period preceding the driving period.

14 Claims, 15 Drawing Sheets

Main initialization period

| STG # | QRST | | | CLK4 | | | CLK1 | | | CLK2 | | | CLK3 | | |
|---|---|---|---|---|---|---|---|---|---|---|---|---|---|---|---|
| | Output | Q | QB | Output | Q | QB | Output | Q | QB | Output | Q | QB | Output | Q | QB |
| #1 | VGH | VGH | VGL | | | | | | | | | | | | |
| #2 | VGH | VGH | VGL | | | | | | | | | | | | |
| #3 | VGH | VGH | VGL | | | | | | | | | | | | |
| #4 | VGH | VGH | VGL | | | | | | | | | | | | |
| #5 | VGH | VGH | VGL | | | | | | | | | | | | |
| #6 | VGH | VGH | VGL | | | | | | | | | | | | |
| #7 | VGH | VGH | VGL | | | | | | | | | | | | |
| #8 | VGH | VGH | VGL | | | | | | | | | | | | |

First sub initialization period

| STG # | QRST | | | CLK4 | | | CLK1 | | | CLK2 | | | CLK3 | | |
|---|---|---|---|---|---|---|---|---|---|---|---|---|---|---|---|
| | Output | Q | QB | Output | Q | QB | Output | Q | QB | Output | Q | QB | Output | Q | QB |
| #1 | VGH | VGH | VGL | VGH | VGH | VGL | | | | | | | | | |
| #2 | VGH | VGH | VGL | VGH | VGH | VGL | | | | | | | | | |
| #3 | VGH | VGH | VGL | VGH | VGH | VGL | | | | | | | | | |
| #4 | VGH | VGH | VGL | VGH | VGH | VGL | | | | | | | | | |
| #5 | VGH | VGH | VGL | VGH | VGH | VGL | | | | | | | | | |
| #6 | VGH | VGH | VGL | VGH | VGH | VGL | | | | | | | | | |
| #7 | VGH | VGH | VGL | VGH | VGH | VGL | | | | | | | | | |
| #8 | VGH | VGH | VGL | VGH | VGH | VGL | | | | | | | | | |

FIG. 8B

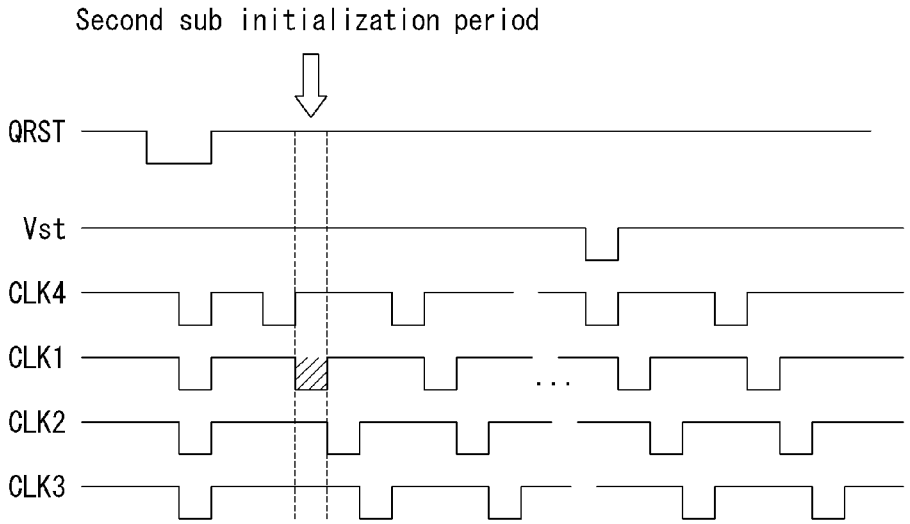

FIG. 8C

Second sub initialization period

| STG # | QRST | | | CLK4 | | | CLK1 | | | CLK2 | | | CLK3 | | |
|---|---|---|---|---|---|---|---|---|---|---|---|---|---|---|---|
| | Output | Q | QB | Output | Q | QB | Output | Q | QB | Output | Q | QB | Output | Q | QB |
| #1 | VGH | VGH | VGL | VGH | VGH | VGL | VGH | VGH | VGL | | | | | | |
| #2 | VGH | VGH | VGL | VGH | VGH | VGL | VGH | VGH | VGL | | | | | | |
| #3 | VGH | VGH | VGL | VGH | VGH | VGL | VGH | VGH | VGL | | | | | | |
| #4 | VGH | VGH | VGL | VGH | VGH | VGL | VGH | VGH | VGL | | | | | | |
| #5 | VGH | VGH | VGL | VGH | VGH | VGL | VGH | VGH | VGL | | | | | | |
| #6 | VGH | VGH | VGL | VGH | VGH | VGL | VGH | VGH | VGL | | | | | | |
| #7 | VGH | VGH | VGL | VGH | VGH | VGL | VGH | VGH | VGL | | | | | | |
| #8 | VGH | VGH | VGL | VGH | VGH | VGL | VGH | VGH | VGL | | | | | | |

FIG. 9B

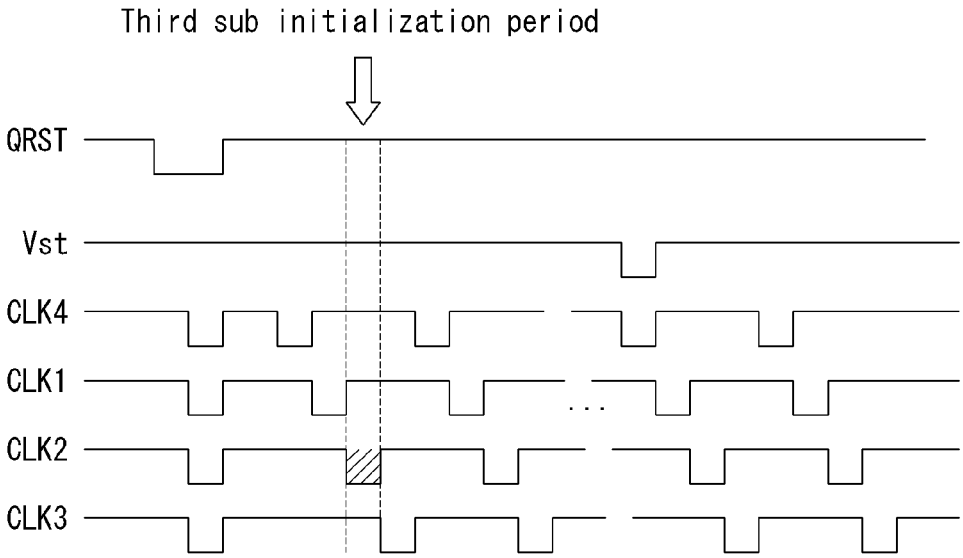

FIG. 9C

Third sub initialization period

| STG # | QRST | | | CLK4 | | | CLK1 | | | CLK2 | | | CLK3 | | |
|---|---|---|---|---|---|---|---|---|---|---|---|---|---|---|---|
| | Output | Q | QB | Output | Q | QB | Output | Q | QB | Output | Q | QB | Output | Q | QB |
| #1 | VGH | VGH | VGL | VGH | VGH | VGL | VGH | VGH | VGL | VGH | VGH | VGL | | | |
| #2 | VGH | VGH | VGL | VGH | VGH | VGL | VGH | VGH | VGL | VGH | VGH | VGL | | | |
| #3 | VGH | VGH | VGL | VGH | VGH | VGL | VGH | VGH | VGL | VGH | VGH | VGL | | | |
| #4 | VGH | VGH | VGL | VGH | VGH | VGL | VGH | VGH | VGL | VGH | VGH | VGL | | | |
| #5 | VGH | VGH | VGL | VGH | VGH | VGL | VGH | VGH | VGL | VGH | VGH | VGL | | | |
| #6 | VGH | VGH | VGL | VGH | VGH | VGL | VGH | VGH | VGL | VGH | VGH | VGL | | | |
| #7 | VGH | VGH | VGL | VGH | VGH | VGL | VGH | VGH | VGL | VGH | VGH | VGL | | | |
| #8 | VGH | VGH | VGL | VGH | VGH | VGL | VGH | VGH | VGL | VGH | VGH | VGL | | | |

FIG. 10B

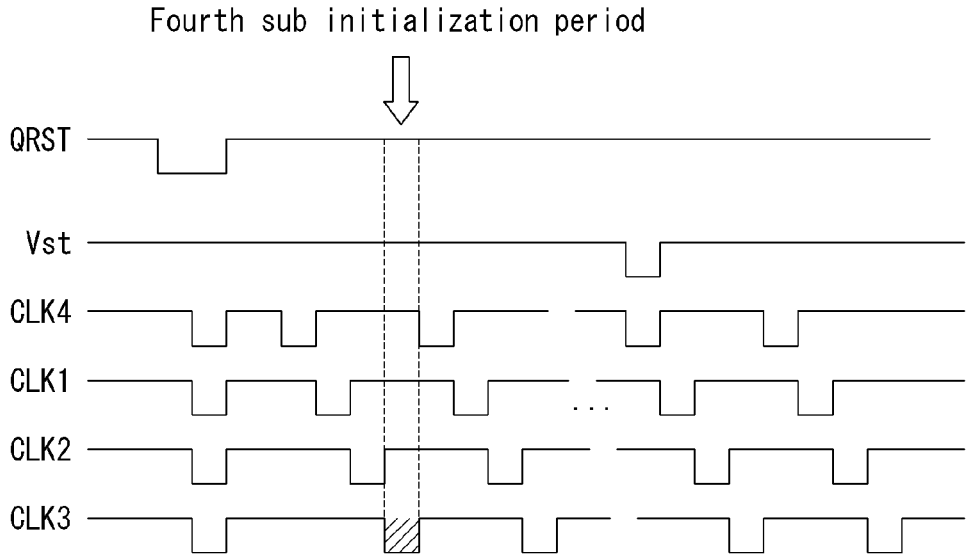

FIG. 10C

Fourth sub initialization period

| STG # | QRST | | | CLK4 | | | CLK1 | | | CLK2 | | | CLK3 | | |
|---|---|---|---|---|---|---|---|---|---|---|---|---|---|---|---|
| | Output | Q | QB | Output | Q | QB | Output | Q | QB | Output | Q | QB | Output | Q | QB |
| #1 | VGH | VGH | VGL | VGH | VGH | VGL | VGH | VGH | VGL | VGH | VGH | VGL | VGH | VGH | VGL |
| #2 | VGH | VGH | VGL | VGH | VGH | VGL | VGH | VGH | VGL | VGH | VGH | VGL | VGH | VGH | VGL |
| #3 | VGH | VGH | VGL | VGH | VGH | VGL | VGH | VGH | VGL | VGH | VGH | VGL | VGH | VGH | VGL |
| #4 | VGH | VGH | VGL | VGH | VGH | VGL | VGH | VGH | VGL | VGH | VGH | VGL | VGH | VGH | VGL |
| #5 | VGH | VGH | VGL | VGH | VGH | VGL | VGH | VGH | VGL | VGH | VGH | VGL | VGH | VGH | VGL |
| #6 | VGH | VGH | VGL | VGH | VGH | VGL | VGH | VGH | VGL | VGH | VGH | VGL | VGH | VGH | VGL |
| #7 | VGH | VGH | VGL | VGH | VGH | VGL | VGH | VGH | VGL | VGH | VGH | VGL | VGH | VGH | VGL |
| #8 | VGH | VGH | VGL | VGH | VGH | VGL | VGH | VGH | VGL | VGH | VGH | VGL | VGH | VGH | VGL |

DISPLAY DEVICE AND METHOD OF INITIALIZING GATE SHIFT REGISTER OF THE SAME

CLAIM FOR PRIORITY

This application claims the benefit of Korean Patent Application No. 10-2013-0164613 filed on Dec. 26, 2013, which is incorporated by reference for all purposes as if fully set forth herein.

BACKGROUND

Field of the Disclosure

This document relates to a display device and a method of initializing the gate shift register of the same.

Discussion of the Related Art

In recent years, various types of flat panel displays FPDs have been developed and commercialized. In general, a scan driving circuit of a flat panel display sequentially supplies a scan pulse to scan lines by using a gate shift register.

The gate shift register of the scan driving circuit comprises a plurality of stages each including a plurality of thin film transistors (TFTs). The stages are cascade-connected to one another and sequentially generate output.

Each of the stages includes a Q node for controlling a pull-up transistor and a Q bar (QB) node for controlling a pull-down transistor. Further, each of the stages includes a plurality of switching circuits for controlling the potential of the Q node and the potential of the QB node in response to a start pulse and a shift clock.

In the k-th (k is a positive integer) stage, a shift clock with a particular phase is input through the pull-up TFT while the potential of the Q node is set to the turn-on level and the potential of the QB node is set to the turn-off level, the shift clock with the particular phase is output as a scan pulse for the k-th stage. This scan pulse is supplied to a scan line connected to the k-th stage and at the same time applied as a start pulse for the (k+1)th stage.

The output ends of the stages are connected one to one to the scan lines. A scan pulse output from each stage is generated once every frame and supplied to the corresponding scan line. To this end, the Q node potential of each stage, initialized to the turn-off level, must be set to the turn-on level prior to the timing of scan pulse output and reset to the turn-off level in synchronization with the timing of completion of scan pulse output. On the other hand, the QB node potential of each stage, initialized to the turn-on level, must be set to the turn-off level prior to the timing of scan pulse output and reset to the turn-on level in synchronization with the timing of completion of scan pulse output.

However, the potentials of the Q node and QB node in each of the stages may not be reset properly due to various factors including parasitic capacitance. This occurs when the display device is intermittently driven at long time intervals, especially on a large-area, high-resolution panel carrying a large load current.

When driving power is applied while the potentials of the Q node and QB node are not reset properly, the pull-up TFTs for different stages are simultaneously turned on for several frames during the initial stage of driving to trigger multiple outputs by which multiple scan pulses are output. Multiple outputs degrade display quality. Moreover, when multiple pull-up TFTs are simultaneously turned on, this may cause over-current and paralyze the operation of a module power supply within the display device.

SUMMARY OF THE DISCLOSURE

An aspect of this disclosure is to provide a display device which increases display quality by stabilizing the initial operation of a gate shift register, and a method of initializing the gate shift register of the same.

An exemplary embodiment of the present invention provides a display device comprising: a display panel; a level shifter shifting a start pulse, an initialization pulse, and N-phase shift clocks, N is an integer equal to or greater than 2, to a predetermined voltage; and a gate shift register comprising multiple stages respectively connected to scan lines of the display panel and shifting the start pulse in response to the N-phase shift clocks within a driving period defined by the start pulse to sequentially output a scan pulse, wherein the stages are simultaneously reset in response to the initialization pulse and the shift clocks within an initialization period preceding the driving period, wherein the initialization period comprises a main initialization period when the initialization pulse is maintained at the turn-on level and a sub-initialization period when the initialization pulse is maintained at the turn-off level, and wherein the N-phase shift clocks are simultaneously input at the turn-on level, slower than the initialization pulse by a predetermined length of time, within the main initialization period.

An ON pulse width of the initialization pulse having the turn-on level is larger than an ON pulse width of the N-phase shift clocks having the turn-on level.

The N-phase shift clocks are sequentially input at the turn-on level within the sub-initialization period, with a predetermined phase difference between the N-phase shift clocks.

Each of the stages comprises: a pull-up TFT connected between an input end of an output clock, output as a scan pulse of one of the N-phase shift clocks, and an output node, and switched on according to the potential of a Q node; a pull-down TFT connected between the input end of a high-potential voltage and the output node and switched on according to the potential of a QB node; a switch TFT connected between an input end of a low-potential voltage and the Q node and switched in response to the start pulse to set the Q node; and a reset switch circuit resetting the potential of the Q node to the turn-off level and at the same time resets the potential of the QB node to the turn-on level, in response to another of the N-phase shift clocks other than the output clock and the initialization pulse, during the initialization period.

The reset switch circuit comprises: a switch TFT turned on in response to the initialization pulse to reset the potential of the Q node to the turn-off level; a switch TFT turned on in response to one of the N-phase shift clocks to reset the potential of the QB node to the turn-on level; and a switch TFT turned on according to the potential of the QB node to reset the potential of the Q node to the turn-off level.

Another exemplary embodiment of the present invention provides a method of initializing a gate shift register of a display device, the gate shift register comprising multiple stages respectively connected to scan lines of a display panel and sequentially generating a scan pulse within a defined driving period, the method comprising: outputting a control signal comprising a start pulse, an initialization pulse, and N-phase shift clocks, N is an integer equal to or greater than 2; and simultaneously resetting the stages in response to the initialization pulse and the N-phase shift clocks within an initialization period preceding the driving period, wherein the initialization period comprises a main initialization period when the initialization pulse is maintained at the turn-on level and a sub-initialization period when the initialization pulse is maintained at the turn-off level, and wherein the N-phase shift clocks are simultaneously input at the turn-on level, slower than the initialization pulse by a predetermined length of time, within the main initialization period.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Hereinafter, an exemplary embodiment of the present invention will be described in detail with reference to FIGS. 1 to 10C.

Figure 1:
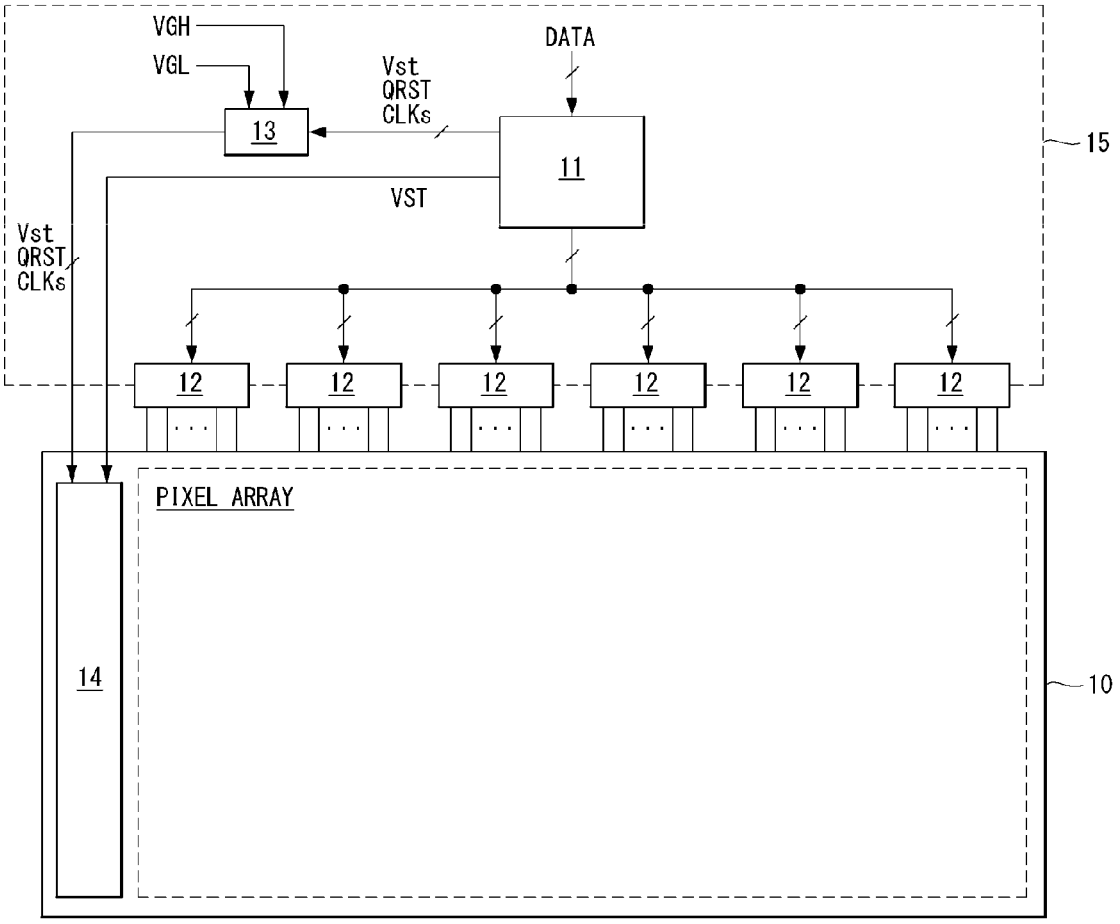
FIG. 1 is a block diagram schematically illustrating a display device according to an exemplary embodiment of the present invention.

FIG. 1 is a block diagram schematically illustrating a display device according to an exemplary embodiment of the present invention.

Referring to FIG. 1, the display device comprises a display panel 10, a data driving circuit, a scan driving circuit, and a timing controller 11.

The display device according to the exemplary embodiment may be any display device which sequentially supplies a scan pulse (or gate pulse) to scan lines (or gate lines) and writes digital video data to pixels by line sequential scanning. For example, the display device according to the exemplary embodiment may be implemented as a liquid crystal display (LCD), an organic light emitting diode display (OLED), a field emission display (FED), or an electrophoresis display (EPD). Although the display device is illustrated as being implemented as a liquid crystal display in the following exemplary embodiment, it is to be noted that the display device of this disclosure is not limited to the liquid crystal display. The liquid crystal display may be in any form, including a transmissive liquid crystal display, a semi-transmissive liquid crystal display, and a reflective liquid crystal display.

A display panel 10 has a liquid crystal layer formed between two substrates. A TFT array is formed on the lower substrate of the display panel 10, and the TFT array comprises data lines, scan lines crossing over the data lines, TFTs (thin film transistors) formed at the crossings of the data lines and the scan lines, liquid crystal cells connected to the TFTs and driven by an electric field between a pixel electrode and a common electrode, and storage capacitors. A color filter array comprising a black matrix and color filters is formed on the upper substrate of the display panel 10. The color filter array and the TFT array constitute a pixel array, and electronic display images are formed on the pixel array.

The liquid crystal display may be implemented in a liquid crystal mode such as a TN (Twisted Nematic) mode, a VA (vertical alignment) mode, an IPS (In Plane Switching) mode, or an FFS (Fringe Field Switching) mode. The common electrode is formed on the upper substrate in a vertical electric field driving method such as the TN mode or the VA mode. On the other hand, the common electrode is formed on the lower substrate together with the pixel electrode in a horizontal electric field driving method such as the IPS mode or the FFS mode. Polarizers at right angles to the optical axis are formed on the upper and lower substrates of the display panel 10, and alignment layers for setting a pre-tilt angle of liquid crystals in an interface contacting the liquid crystal layer is formed on the upper and lower substrates of the display panel 10.

The data driving circuit comprises a plurality of source drive ICs 12. The source drive ICs 12 receive digital video data DATA from the timing controller 11. The source drive ICs 12 each convert the digital video data DATA into a gamma compensation voltage in response to a source timing control signal from the timing controller 11 to generate a data voltage, and supply the data voltage to the data lines of the display panel 10 in synchronization with a gate pulse. The source drive ICs 12 may be connected to the data lines of the display panel 10 by a COG (Chip On Glass) process or TAB (Tape Automated Bonding) process.

The scan driving circuit comprises a level shifter 13 connected between the timing controller 11 and the scan lines of the display panel 10 and a gate shift register 14.

The level shifter 13 receives a control signal including a start pulse Vst, an initialization pulse QRST, and N-phase (N is an integer equal to or greater than 2) shift clocks CLKs. The level shifter 13 shifts the TTL (transistor-transistor-logic) logic level voltage of the control signal to a gate-high voltage VGH or gate-low voltage VGL at which the TFTs of the gate shift register 14 can be switched on. The level shifter 13 supplies the start pulse Vst, initialization pulse QRST, and N-phase shift clocks CLKs, which have been shifted in level, to the gate shift register 14.

The gate shift register 14 comprises stages for shifting the start pulse Vst in response to the N-phase shift clocks CLKs within a driving period determined in response to the start pulse Vst and sequentially outputting a scan pulse. Particularly, the stages are characterized in that they are simultaneously reset in response to the initialization pulse Vst and the N-phase shift clocks CLKs within an initialization period preceding the driving period. A detailed description and initialization operation of the gate shift register 14 will be described later with reference to FIGS. 2 to 10C.

The gate shift register 14 may be formed directly on the lower substrate of the display panel 10 in a GIP (gate-in-panel) manner. In the GIP manner, the level shifter 13 may be mounted on a PCB (printed-circuit board) 15. The gate shift register 14 is formed in a non-display area (i.e., bezel area) outside the pixel array on the display panel 10 in the same process as the pixel array.

The timing controller 11 receives digital video data DATA from an external host computer through an interface such as an LVDS (low voltage differential signaling) interface or a TMDS (transition minimized differential signaling) interface. The timing controller 11 transmits the digital video data DATA input from the host computer to the source drive ICs 12.

The timing controller 11 receives a timing signal such as a vertical synchronization signal Vsync, a horizontal synchronization signal Hsync, a data enable signal DE, or a main clock MCLK from the host computer through an LVDS or TMDS interface receiving circuit. The timing controller 11 generates timing control signals for controlling the operation timing of the data driving circuit and the scan driving circuit based on the timing signal received from the host computer. The timing control signals comprise a scan timing control signal for controlling the operation timing of the scan driving circuit and a data timing control signal for controlling the operation timing of the source drive ICs 12 and the polarity of a data voltage.

The scan timing control signal comprises an initialization pulse QRST, a start pulse Vst, N-phase shift clock CLKs, a gate output enable signal GOE (not shown), etc.

The initialization pulse QRST is level-shifted through the level shifter 13 and then input into the gate shift register 14 and used as a reset signal for simultaneously resetting all the stages of the gate shift register 14 during the initialization period. The initialization pulse QRST is characterized in that it has a much larger pulse width than that of shift clocks CLKs to achieve stable initialization. The start pulse Vst is level-shifted through the level shifter 13 and then input into the gate shift register 14 to control shift start timing. The N-phase shift clocks CLKs are level-shifted through the level shifter 13 and then input into the gate shift register 14 and used as clock signals for shifting the start pulse Vst.

The data timing control signal comprises a source start pulse SSP, a source sampling clock SSC, a polarity control signal POL, a source output enable signal SOE, etc. The source start pulse SSP controls the shift start timing of the source drive ICs 12. The source sampling clock SSC is a clock signal which controls the data sampling timing in the source drive ICs 12 based on a rising edge or falling edge. The polarity control signal POL controls the polarity of a data voltage output from the source drive ICs 12. If a data transmission interface between the timing controller 11 and the source drive ICs 12 is a mini LVDS interface, the source start pulse SSP and the source sampling clock SSC may be omitted.

Figure 2:
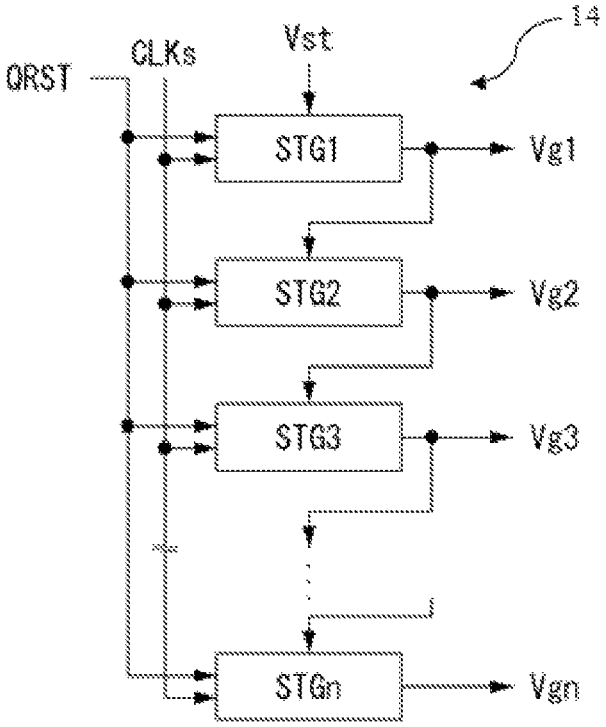
FIG. 2 illustrates one configuration of a gate shift register.
Figure 3:
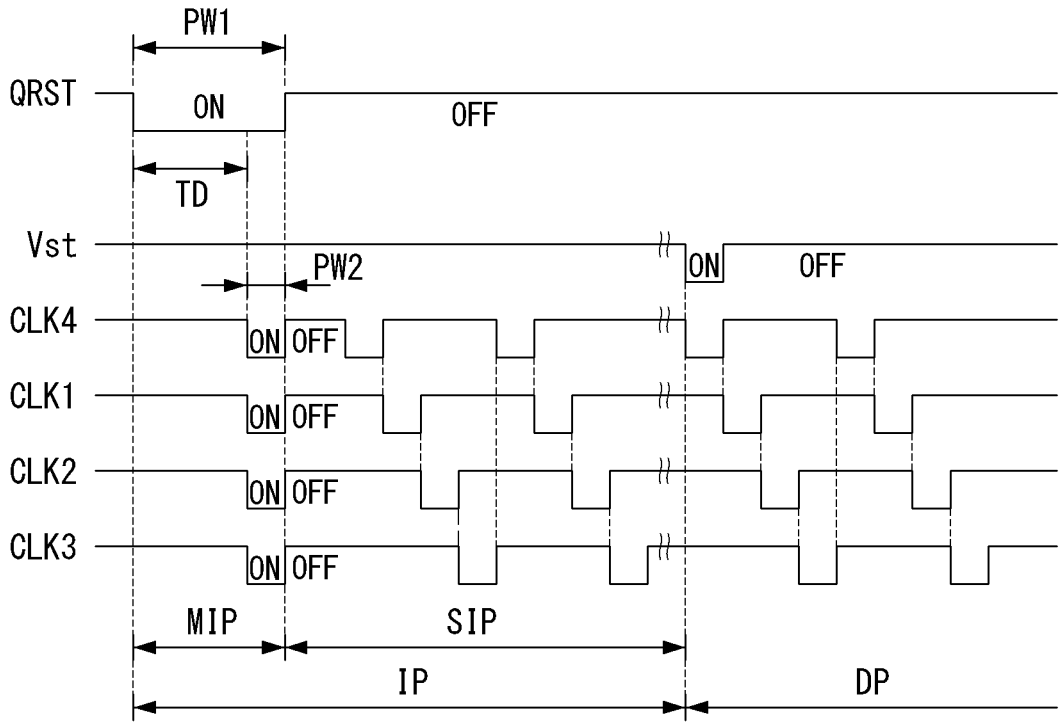
FIG. 3 illustrates one example of control signals input into the gate shift register.
Figure 4:
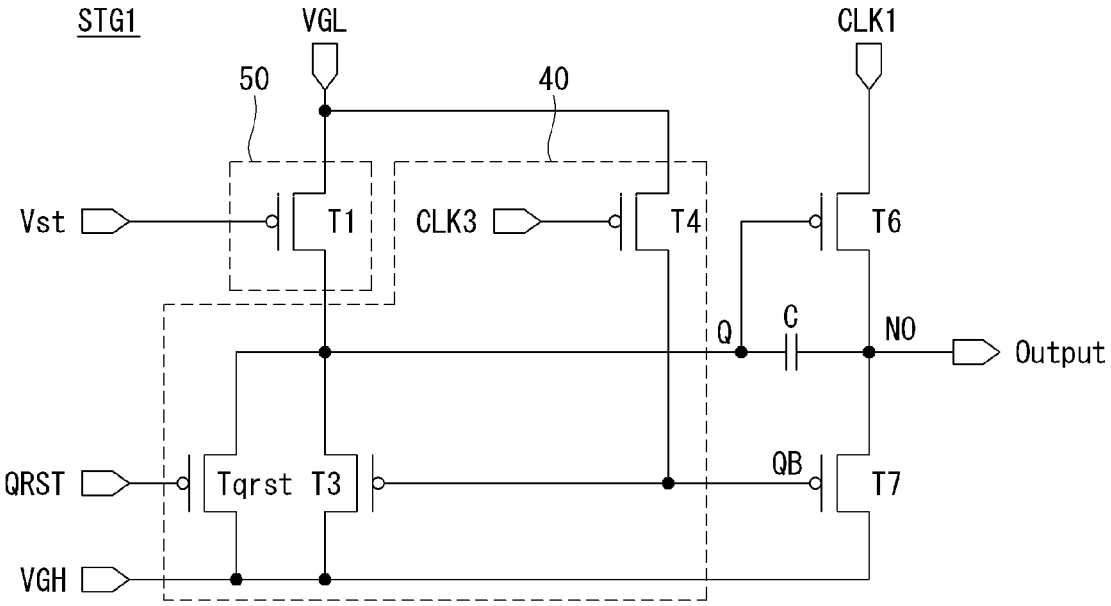
FIGS. 4 and 5 illustrate an equivalent circuit of each stage of the gate shift register.
Figure 5:
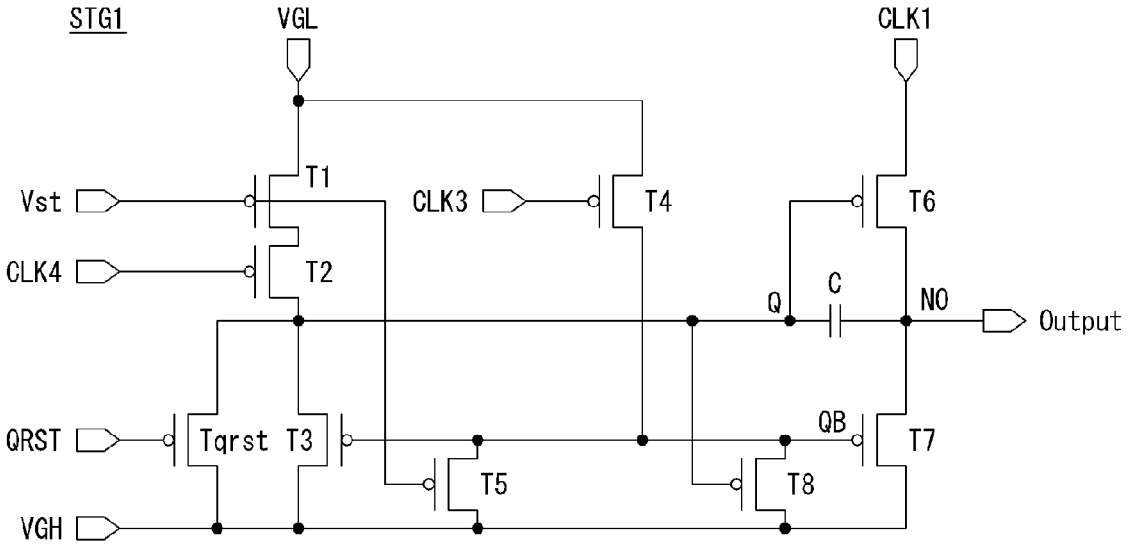

FIG. 2 shows one configuration of the gate shift register 14. FIG. 3 shows one example of control signals input into the gate shift register 14. FIGS. 4 and 5 show an equivalent circuit of each stage of the gate shift register 14.

Referring to FIGS. 2 and 3, the gate shift register 14 comprises a plurality of stages STG1 to STGn dependently connected to one another. The output ends of the stages STG1 to STGn are connected one to one to the scan lines.

The stages STG1 to STGn generate gate output signals Vg1 to Vgn in response to the start pulse Vst and the N-phase shift clocks CLKs. The gate output signals Vg1 to Vgn are sequentially shifted in phase in response to the N-phase shift clocks CLKs. The N-phase shift clocks CLKs may be shift clocks whose phase is 2 or more. Although the N-phase shift clocks CLKs of the present disclosure are illustrated as 4-phase shift clocks CLK1 to CLK4, it is to be noted that the technical spirit of the present invention is not limited to this example. The start pulse Vst is applied to the first stage to control the shift start timing of the gate output signals Vg1 to Vgn, and defines a driving period DO during which the gate output signals Vg1 to Vgn are normally output. Each of the gate output signals Vg1 to Vgn is applied as a scan pulse to the scan line to which the current stage is connected, and used as a carry signal that controls the start timing of the next stage. Accordingly, the other stages after the first stage are set in response to a gate output signal of a neighboring previous stage and start working.

Setting a stage means that the potentials of the Q and QB nodes of the stage are changed under a condition permitting scan pulse output. The condition permitting scan pulse output is that the potential of the Q node should be at the turn-on level and the potential of the QB node should be at the turn-off level.

The stages STG1 to STGn receive an initialization pulse QRST, and simultaneously reset in response to the initialization pulse QRST and the shift clocks CLK1 to CLK4 within an initialization period IP preceding the driving period DP.

Resetting a stage means that the potentials of the Q and QB nodes of the stage are changed under a condition preventing scan pulse output. The condition preventing scan pulse output is that the potential of the Q node should be at the turn-off level and the potential of the QB node should be at the turn-on level.

The initialization pulse QRST defines the initialization period IP. The initialization period IP is a period that begins immediately after input of the initialization pulse QRST at the turn-on level and continues until input of the start pulse Vst at the turn-on level.

The initialization period IP comprises a main initialization period MIP when the initialization pulse QRST is maintained at the turn-on level and a sub initialization period SIP when the initialization pulse QRST is maintained at the turn-off level. In order to improve the reliability of the initialization operation, the shift clocks CLK1 to CLK4 are simultaneously input at the turn-on level, slower than the initialization pulse QRST by a predetermined length of time TD, within the main initialization period MIP. The ON pulse width PW1 of the initialization pulse QRST is larger than the ON pulse width PW2 of the shift clocks CLK1 to CLK4 having the turn-on level. The initialization pulse QRST is heavily loaded when applied because it is used to initialize all of the stages STG1 to STGn simultaneously. Accordingly, the ON pulse width PW1 of the initialization pulse QRST may be 3 to 250 times larger than the ON pulse width PW2 of the shift clocks CLK1 to CLK4 in order to achieve stable initialization.

Moreover, the initialization pulse QRST must be first input at the turn-on level earlier than the shift clocks CLK1 to CLK4 by a predetermined length of time TD, taking into account the load difference between the initialization pulse QRST and the shift clocks CLK1 and CLK4. The predetermined length of time TD may be properly determined depending on the load difference. Although FIG. 3 illustrates the shift clocks CLK1 to CLK4 as synchronized with the end portion of the main initialization period MIP, the technical spirit of the present invention is not limited to this example. The shift clocks CLK1 to CLK4 will suffice as long as they are input at the turn-on level slower than the initial pulse QRST within the main initialization period MIP.

To further improve the reliability of the initialization operation, the shift clocks CLK1 to CLK4 are sequentially input at the turn-on level within the sub initialization period SIP, with a predetermined phase difference between them.

The circuit configuration of each of the stages STG1 to STGn will be described with reference to FIGS. 4 and 5 by taking the first stage STG1 as an example. Although the TFTs constituting each stage are illustrated as P-type in the exemplary embodiment of the present invention, it is obvious that the technical spirit of the present invention is not limited to this example but applicable to a stage otherwise comprising N-type TFTs. In a stage comprising P-type TFTs, a low-potential voltage VGL acts as a turn-on driving voltage, and a high-potential voltage VGH acts as a turn-off driving voltage.

Referring to FIG. 4, the first stage STG1 comprises a pull-up TFT T6 that is switched on according to the potential of the Q node, a pull-down TFT T7 that is switched on according to the potential of the QB node, a reset switch circuit 40 for resetting the Q node and the QB node, and a set switch circuit 50 for setting the Q node and the QB node.

The pull-up TFT T6 is connected between the input end of an output clock CLK1 (changing depending on the stage), which is one of the shift clocks CLK1 to CLK4 and that is output as a scan pulse, and an output node No, and switched on according to the potential of the Q node. A control electrode of the pull-up TFT T6 is connected to the Q node, its first electrode is connected to the input end of the output clock CLK1, and its second electrode is connected to the output node NO. A boost capacitor C is connected between the control electrode of the pull-up TFT T6 and the output node NO. When the output clock CLK1 is input after the Q node and the QB node have been set, the boost capacitor C boost-straps the control electrode of the pull-up TFT T6 in synchronization with the output clock CLK1, thus effectively turning on the pull-up TFT T6.

The pull-down TFT T7 is connected between the input end of the high-potential voltage VGH and the output node NO and switched on according to the potential of the QB node. A control electrode of the pull-down TFT T7 is connected to the QB node, its first electrode is connected to the output node NO, and its second electrode is connected to the input end of the high-potential voltage VGH.

The reset switch circuit 40 functions to reset the Q node and the QB node. The reset switch circuit 40 resets the potential of the Q node to the turn-off level and at the same time resets the potential of the QB node to the turn-on level, in response to some other shift clock, for example CLK3, than the output clock CLK1 and the initialization pulse QRST. The shift clock CL3 may be any one of the shift clocks CLK2 to CLK, other than the output clock CLK1, which does not overlap with the output clock CLK1.

The reset switch circuit 40 may comprise a switch TFT Tqrst, a switch TFT T4, and a switch TFT T3.

The switch TFT Tqrst is turned on in response to the initialization pulse QRST to reset the potential of the Q node to the turn-off level. A control electrode of the switch TFT Tqrst is connected to the input end of the initialization pulse QRST, its first electrode is connected to the Q node, and its second electrode is connected to the input end of the high-potential voltage VGH. The switch TFT T4 is turned on in response to some shift clock CLK3 to reset the potential of the QB node to the turn-on level. A control electrode of the switch TFT T4 is connected to the input end of the shift clock CLK3, its first electrode is connected to the input end of the low-potential voltage VGL, and its second electrode is connected to the QB node. The switch TFT T3 is turned on according to the potential of the QB node to reset the potential of the Q node to the turn-off level. A control electrode of the switch TFT T3 is connected to the QB node, its electrode is connected to the Q node, and its second electrode is connected to the input end of the high-potential voltage VGH.

The set switch circuit 50 sets the potential of the Q node to the turn-on level and at the same time sets the potential of the QB node to the turn-off level, in response to the start pulse Vst. The set switch circuit 50 may be implemented as a switch TFT T1, as shown in FIG. 4. A control electrode of the switch TFT T1 is connected to the input end of the start pulse Vst, its first electrode is connected to the input end of the low-potential voltage VGL, and its second electrode is connected to the Q node.

The set switch circuit 50 may further comprise a switch TFT T2, a switch TFT T5, and a switch TFT T8, as shown in FIG. 5. A control electrode of the switch TFT T2 is connected to the input end of the shift clock CLK4, its first electrode is connected to the second electrode of the switch TFT T1, and its second electrode is connected to the Q node. A control electrode of the switch TFT T5 is connected to the input end of the start pulse Vst, its first electrode is connected to the QB node, and its second electrode is connected to the input end of the high-potential voltage VGH. A control electrode of the switch TFT T8 is connected to the Q node, its first electrode is connected to the QB node, and its second electrode is connected to the input end of the high-potential voltage VGH.

Figure 6A:
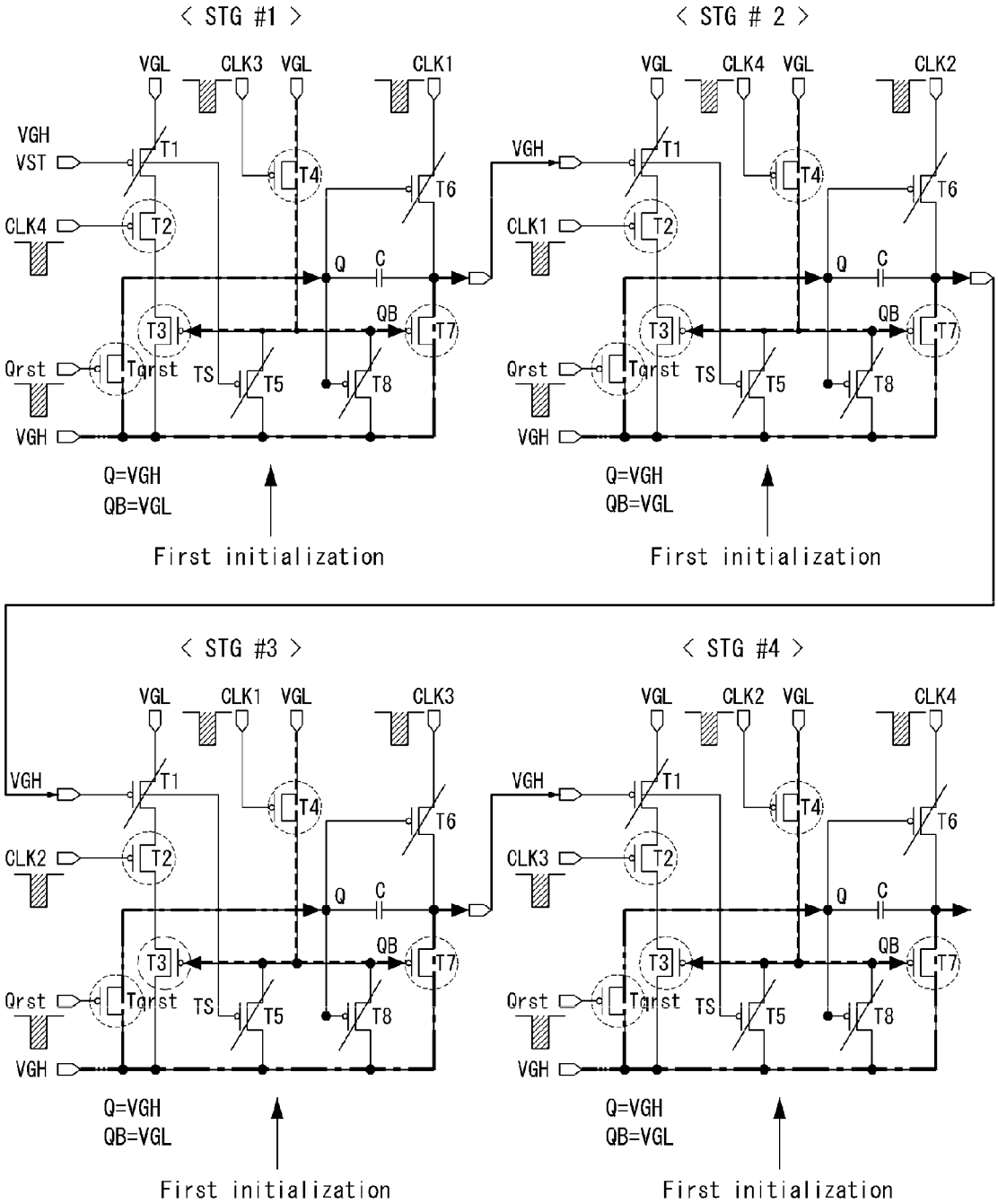
FIGS. 6A to 6C are views for illustrating a first initialization operation of stages during a main initialization period.
Figures 6B, 6C:
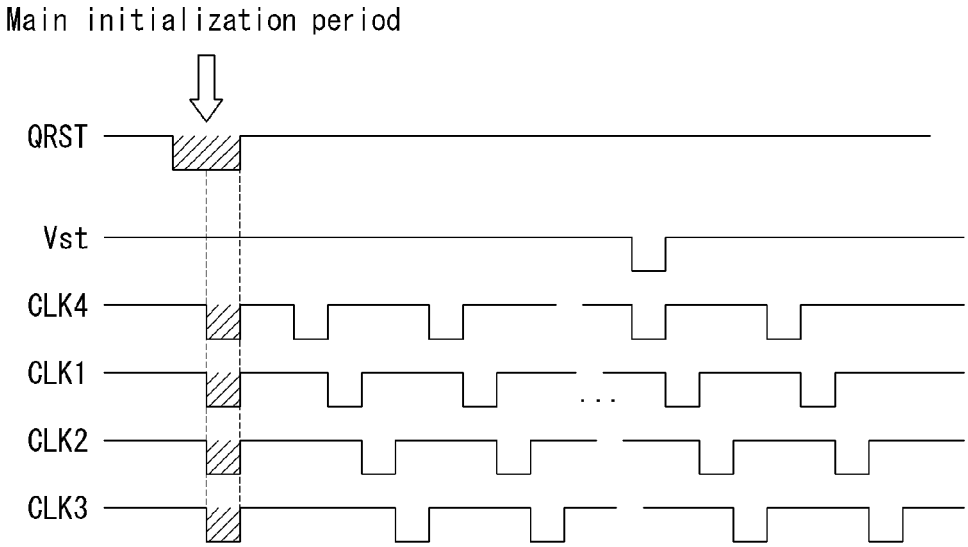

FIGS. 6A to 6C are views illustrating a first initialization operation of stages during the main initialization period.

In the main initialization period, first, the initialization pulse QRST is first input at the turn-on level, and the shift clocks CLK1 to CLK4 are then simultaneously input at the turn-on level. The stages STG are simultaneously reset during the main initialization period. As a consequence, the Q node of each of the stages STG is firstly initialized to the high-potential voltage VGH of the turn-off level, its QB node is firstly initialized to the low-potential voltage VGL of the turn-on level, and its output node is firstly initialized to the high-potential voltage VGH of the turn-off level.

FIGS. 7A to 10C are views for explaining a second initialization operation of stages during the sub initialization period.

Figure 7A:
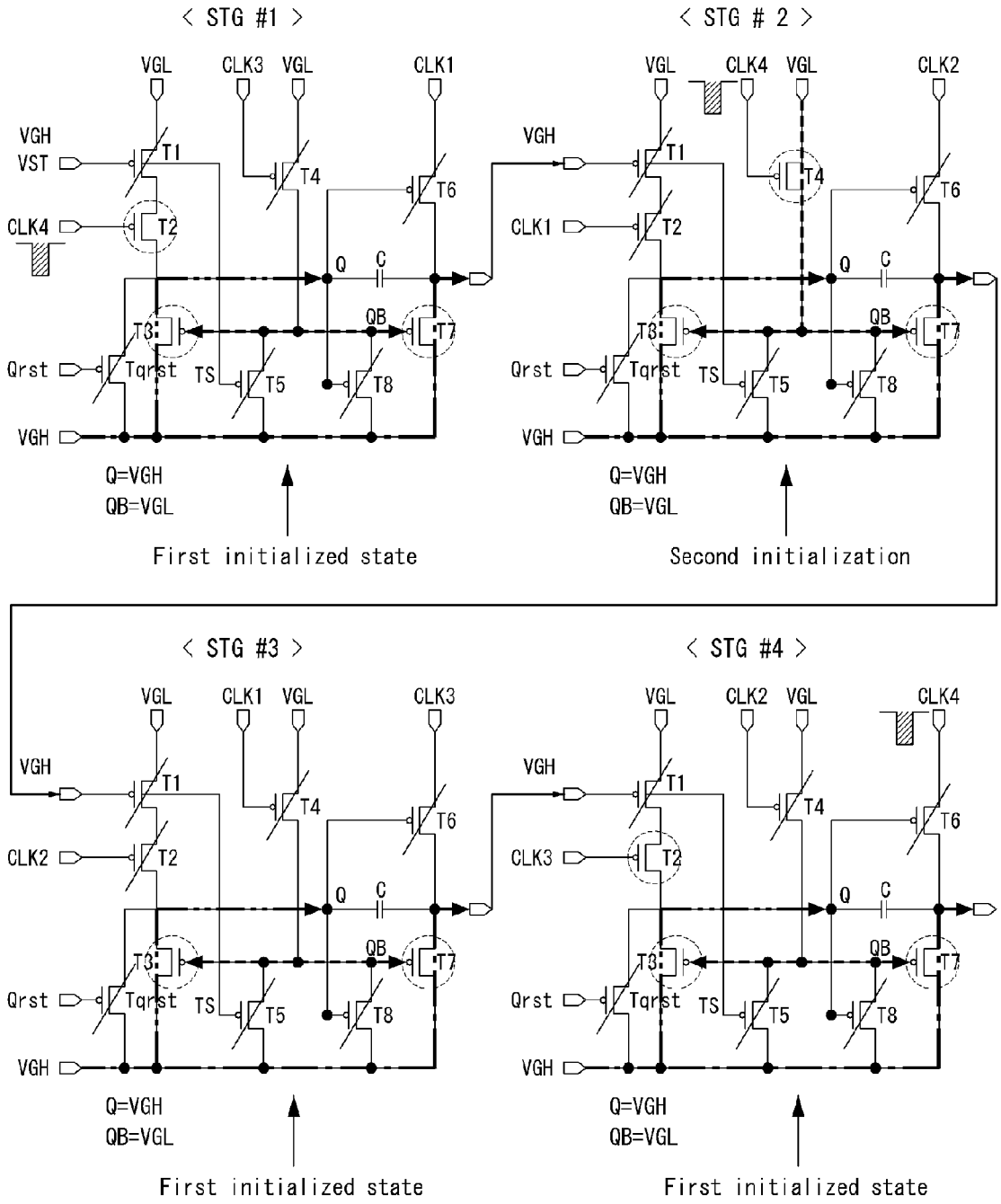
FIGS. 7A to 10C are views illustrating a second initialization operation of stages during a sub initialization period.
Figures 7B, 7C:
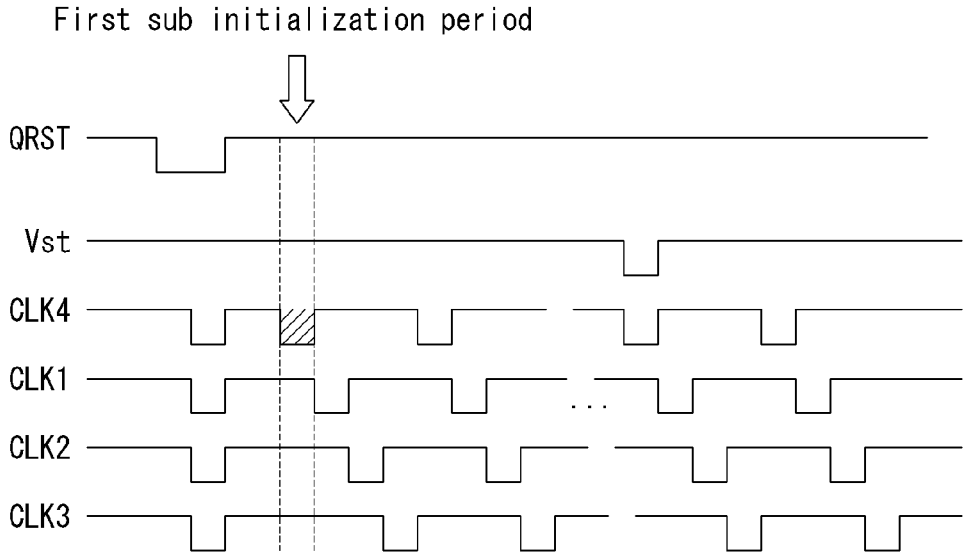

FIGS. 7A to 7C show a second initialization operation of some stages during a first sub initialization period.

In the first sub initialization period, the shift clock CLK4 is input at the turn-on level, multiple (4k+2) (k is a positive integer including zero) stages STG2, STG6, . . . are simultaneously reset in response to the shift clock CLK4. As a consequence, the Q node of each of the (4k+2) stages STG2, STG6, . . . is secondly initialized to the high-potential voltage VGH of the turn-off level, its QB node is secondly initialized to the low-potential voltage VGL of the turn-on level, and its output node is secondly initialized to the high-potential voltage VGH of the turn-off level. Meanwhile, the (4k+1)th, (4k+3)th, and (4k+4)th stages are kept in the first initialized state.

FIGS. 7A to 10C are views for explaining a second initialization operation of stages during the sub initialization period.

Figure 8A:
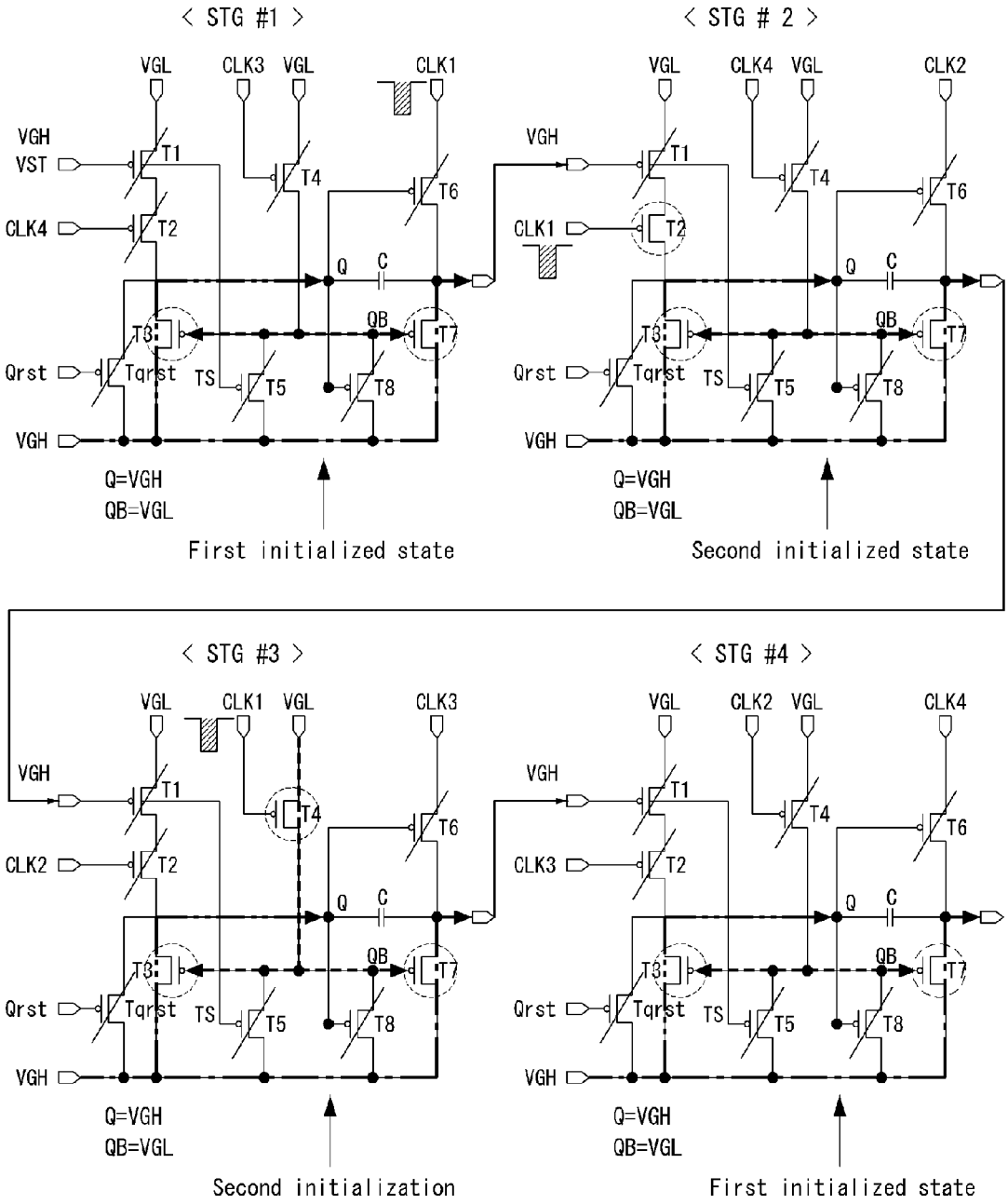

FIGS. 8A to 8C show a second initialization operation of some stages during a second sub initialization period.

In the second sub initialization period, the shift clock CLK1 is input at the turn-on level, multiple (4k+3) stages STG3, STG7, . . . are simultaneously reset in response to the shift clock CLK1. As a consequence, the Q node of each of the (4k+3) stages STG3, STG7, . . . is secondly initialized to the high-potential voltage VGH of the turn-off level, its QB node is secondly initialized to the low-potential voltage VGL of the turn-on level, and its output node is secondly initialized to the high-potential voltage VGH of the turn-off level. Meanwhile, the (4k+1)th and (4k+4)th stages are kept in the first initialized state, and the (4k+2)th stages are kept in the second initialized state.

Figure 9A:
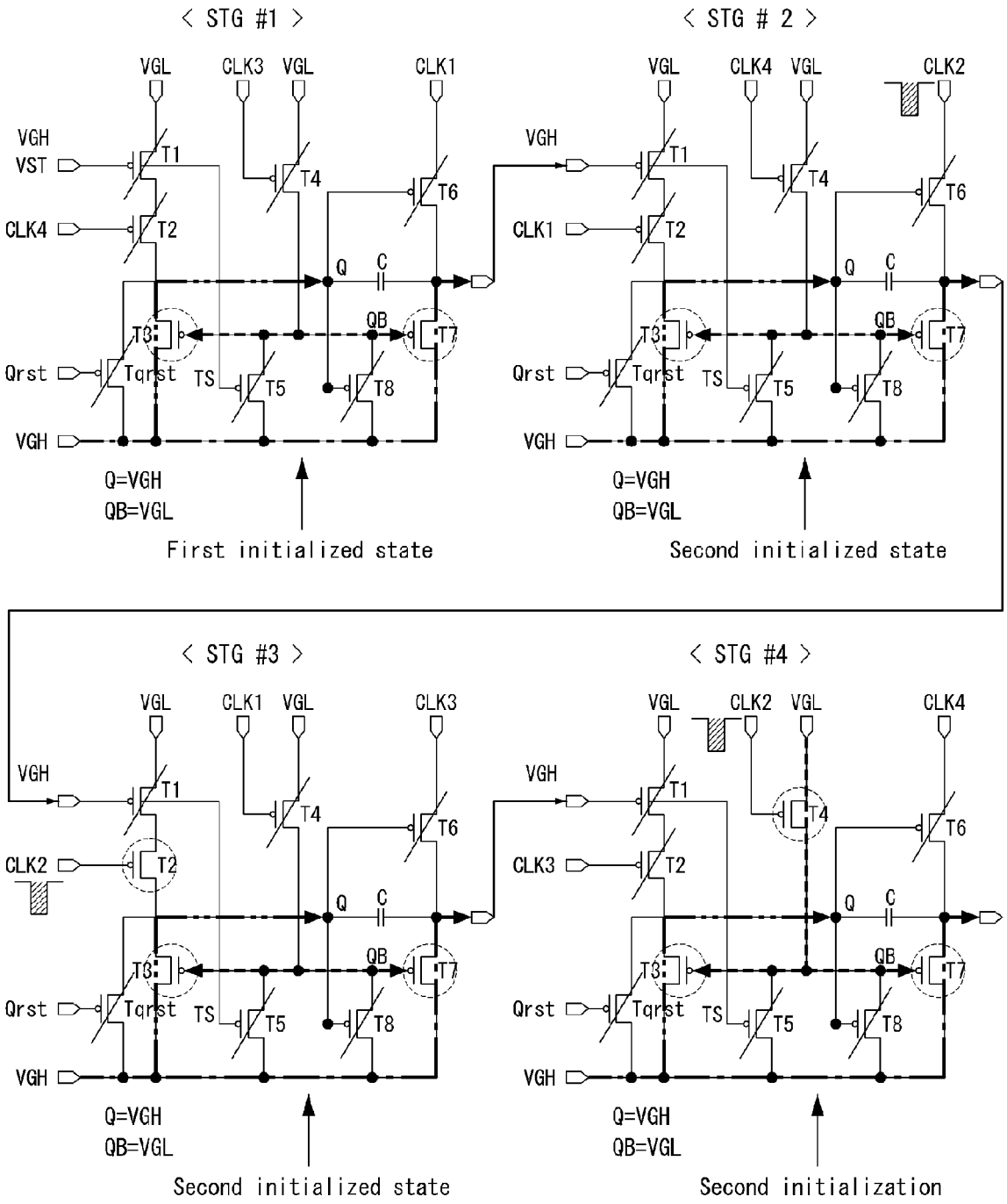

FIGS. 9A to 9C show a second initialization operation of some stages during a third sub initialization period.

In the third sub initialization period, the shift clock CLK2 is input at the turn-on level, multiple (4k+4) stages STG4, STG8, . . . are simultaneously reset in response to the shift clock CLK2. As a consequence, the Q node of each of the (4k+4) stages STG4, STG8, . . . is secondly initialized to the high-potential voltage VGH of the turn-off level, its QB node is secondly initialized to the low-potential voltage VGL of the turn-on level, and its output node is secondly initialized to the high-potential voltage VGH of the turn-off level. Meanwhile, the (4k+1)th stages are kept in the first initialized state, and the (4k+2)th and (4k+3)th stages are kept in the second initialized state.

Figure 10A:
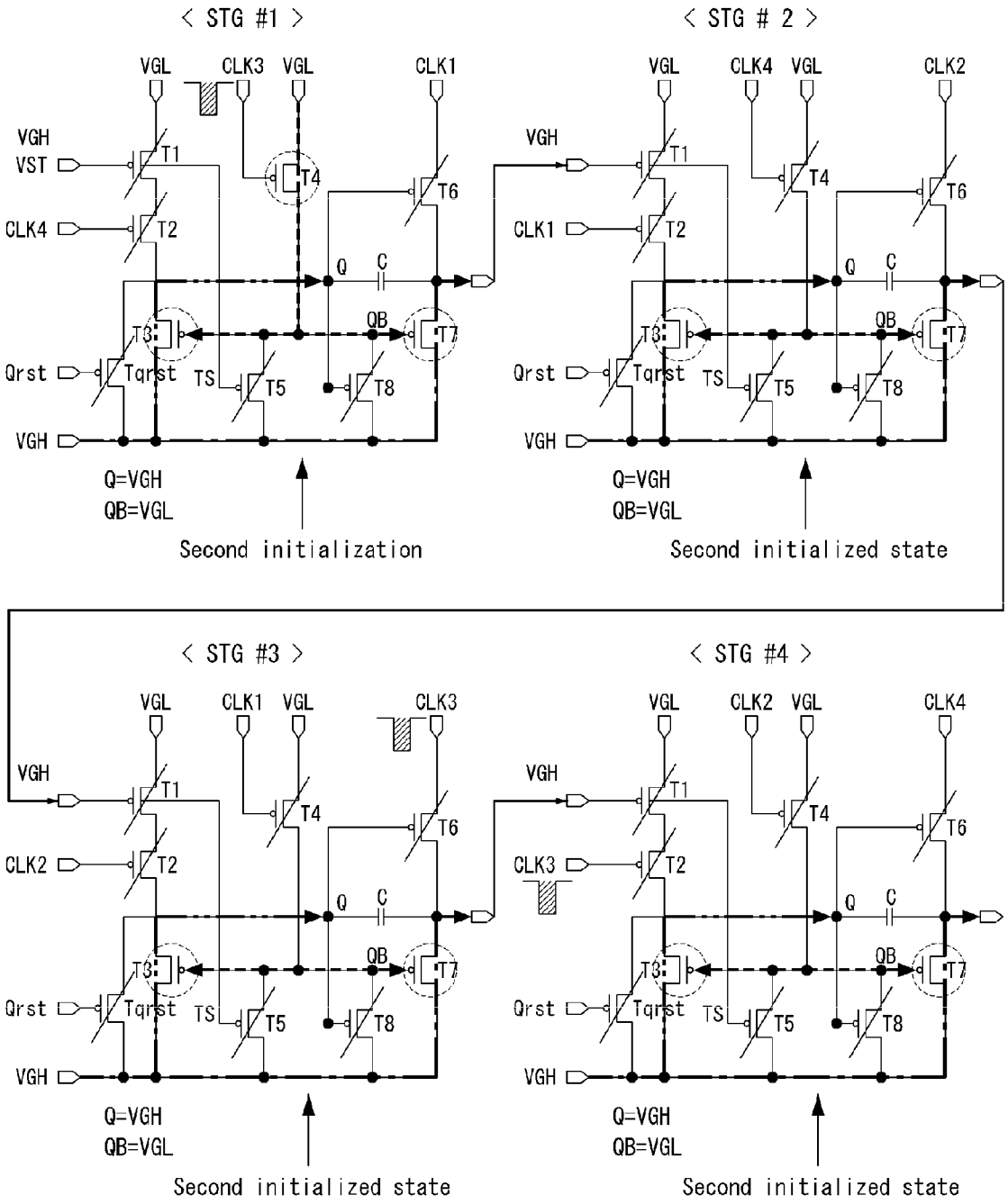

FIGS. 10A to 10C show a second initialization operation of some stages during a fourth sub initialization period.

In the fourth sub initialization period, the shift clock CLK3 is input at the turn-on level, multiple (4k+1) stages STG1, STG5, . . . are simultaneously reset in response to the shift clock CLK3. As a consequence, the Q node of each of the (4k+1) stages STG1, STG5, . . . is secondly initialized to the high-potential voltage VGH of the turn-off level, its QB node is secondly initialized to the low-potential voltage VGL of the turn-on level, and its output node is secondly initialized to the high-potential voltage VGH of the turn-off level. Meanwhile, the (4k+2)th and (4k+4)th stages are kept in the second initialized state.

In this way, the initialization operation may be repeated multiple times during the sub initialization period.

As described above in detail, according to the present invention, an initialization pulse and shift clocks are input at the turn-on level during the initialization period preceding the driving period to simultaneously reset the stages, thereby stabilizing the initial operation of the gate shift register. Moreover, the shift clocks are input at the turn-on level, slower than the initialization pulse by a predetermined length of time, within the main initialization period while the initialization pulse is at the turn-on level, by taking the load difference between the initialization pulse and the shift clocks into account in the initialization process. This improves the reliability of the initialization operation.

Furthermore, the reliability of the initialization operation can be further improved by repeatedly initializing the stages in response to sequentially input shift clocks during the sub initialization period subsequent to the main initialization period.

From the foregoing description, those skilled in the art will readily appreciate that various changes and modifications can be made without departing from the technical idea of the present invention. Therefore, the technical scope of the present invention is not limited to the contents described in the detailed description of the specification but defined by the appended claims.

What is claimed is:

1. A display device comprising:

a display panel;

a level shifter shifting a start pulse, an initialization pulse, and N-phase shift clocks, N being an integer equal to or greater than 2, to a predetermined voltage; and a gate shift register comprising stages respectively connected to scan lines of the display panel and shifting the start pulse in response to the N-phase shift clocks within a driving period defined by the start pulse to sequentially output a scan pulse, wherein the stages are simultaneously reset in response to the initialization pulse and the N-phase shift clocks within an initialization period preceding the driving period, wherein the initialization period comprises a main initialization period when the initialization pulse is maintained at a turn-on level, and a sub-initialization period when the initialization pulse is maintained at a turn-off level, and wherein the N-phase shift clocks are simultaneously input with a turn-on level that is later in time than the turn-on level of the initialization pulse by a predetermined length of time which is a number greater than 0, within the main initialization period.

2. The display device of claim 1, wherein an ON pulse width of the initialization pulse having the turn-on level is larger than the ON pulse width of the N-phase shift clocks having the turn-on level.

3. The display device of claim 2, wherein the ON pulse width of the initialization pulse is 3 to 250 times larger than the ON pulse width of the N-phase shift clocks.

4. The display device of claim 1, wherein the N-phase shift clocks are sequentially input at the turn-on level within the sub-initialization period, with a predetermined phase difference between the N-phase shift clocks.

5. The display device of claim 1, wherein each of the stages comprises:

a pull-up TFT connected between an input end of an output clock, which is output as a scan pulse of one of the N-phase shift clocks, and an output node, and switched on according to the potential of a Q node;

a pull-down TFT connected between an input end of a high-potential voltage and the output node and switched on according to the potential of a QB node;

a switch TFT connected between an input end of a low-potential voltage and the Q node and switched in response to the start pulse to set the Q node; and a reset switch circuit resetting the potential of the Q node to the turn-off level and at the same time resets the potential of the QB node to the turn-on level, in response to another of the N-phase shift clocks other than the output clock and the initialization pulse, during the initialization period.

6. The display device of claim 5, wherein the reset switch circuit comprises:

a switch TFT turned on in response to the initialization pulse to reset the potential of the Q node to the turn-off level;

a switch TFT turned on in response to one of the N-phase shift clocks to reset the potential of the QB node to the turn-on level; and a switch TFT turned on according to the potential of the QB node to reset the potential of the Q node to the turn-off level.

7. The display device of claim 1, wherein the predetermined length of time is based on a load difference between the initialization pulse and the N-phase shift clocks.

8. The display device of claim 1, wherein the initialization period begins immediately after input of the initialization pulse and continues until input of the start pulse.

9. A method of initializing a gate shift register of a display device, the gate shift register comprising stages respectively connected to scan lines of a display panel and sequentially generating a scan pulse within a defined driving period, the method comprising:

outputting a control signal comprising a start pulse, an initialization pulse, and N-phase shift clocks, N being an integer equal to or greater than 2; and simultaneously resetting the stages in response to the initialization pulse and the N-phase shift clocks within an initialization period preceding the driving period, wherein the initialization period comprises a main initialization period when the initialization pulse is maintained at a turn-on level and a sub-initialization period when the initialization pulse is maintained at a turn-off level, and wherein the N-phase shift clocks are simultaneously input with a turn-on level that is later in time than the turn-on level of the initialization pulse by a predetermined length of time which is a number greater than 0, within the main initialization period.

10. The method of claim 9, wherein an ON pulse width of the initialization pulse having the turn-on level is larger than an ON pulse width of the N-phase shift clocks having the turn-on level.

11. The method of claim 10, wherein the ON pulse width of the initialization pulse is 3 to 250 times larger than the ON pulse width of the N-phase shift clocks.

12. The display device of claim 9, wherein the N-phase shift clocks are sequentially input at the turn-on level within the sub-initialization period, with a predetermined phase difference between the N-phase shift clocks.

13. The method of claim 9, wherein the predetermined length of time is based on a load difference between the initialization pulse and the N-phase shift clocks.

14. The method of claim 9, wherein the initialization period begins immediately after input of the initialization pulse and continues until input of the start pulse.

* * * * *